US009336750B2

(12) United States Patent
Zhang et al.

(10) Patent No.: US 9,336,750 B2
(45) Date of Patent: May 10, 2016

(54) BACKLIGHT CONTROL METHOD AND DEVICE AND LIQUID CRYSTAL DISPLAY DEVICE

(71) Applicants: Hisense Electric Co., Ltd, Qingdao, Shandong (CN); HISENSE USA CORPORATION, Suwanee, GA (US)

(72) Inventors: Yuxin Zhang, Qingdao (CN); Jia Yang, Qingdao (CN); Weidong Liu, Qingdao (CN); Mingsheng Qiao, Qingdao (CN)

(73) Assignees: Hisense Electric Co., Ltd, Qingdao (CN); HISENSE USA CORPORATION, Suwanee, GA (US)

( * ) Notice: Subject to any disclaimer, the term of this patent is extended or adjusted under 35 U.S.C. 154(b) by 0 days.

(21) Appl. No.: 14/317,999

(22) Filed: Jun. 27, 2014

(65) Prior Publication Data

US 2015/0364111 A1 Dec. 17, 2015

(30) Foreign Application Priority Data

Jun. 16, 2014 (CN) ..... 2014 1 0268690

(51) Int. Cl.
*G09G 3/36* (2006.01)
*G09G 5/10* (2006.01)

(52) U.S. Cl.
CPC ..... *G09G 5/10* (2013.01); *G09G 3/3611* (2013.01); *G09G 2330/021* (2013.01)

(58) Field of Classification Search
CPC ..... G09G 3/342
USPC ..... 345/102
See application file for complete search history.

(56) References Cited

U.S. PATENT DOCUMENTS

| | | | | |
|---|---|---|---|---|
| 7,436,415 | B2 * | 10/2008 | Takata et al. | 345/690 |
| 7,638,754 | B2 * | 12/2009 | Morimoto et al. | 250/226 |
| 2007/0030697 | A1 * | 2/2007 | Kim | 362/618 |
| 2010/0066657 | A1 * | 3/2010 | Park et al. | 345/94 |

* cited by examiner

*Primary Examiner* — Roy Rabindranath
(74) *Attorney, Agent, or Firm* — Knobbe Martens Olson & Bear LLP

(57) ABSTRACT

Embodiments provide a backlight control method and device and a liquid crystal display device, which relate to the liquid crystal display field and are used to achieve the purposes of meeting the requirements on different image quality enhancements in different display regions of the liquid crystal screen and improving the display quality and the sense of display layering of pictures. The method comprises: dividing n backlight subregions into m backlight regions; acquiring an average backlight value of each backlight region among the m backlight regions; searching, from a pre-acquired gain search table, a gain value corresponding to the average backlight value of each backlight region among the m backlight regions; adjusting backlight values of backlight subregions contained in each backlight region correspondingly according to the gain value corresponding to each backlight region; and outputting adjusted backlight values of the n backlight subregions. The embodiments are applicable to backlight adjustment scenes.

20 Claims, 6 Drawing Sheets

BACKLIGHT CONTROL METHOD AND DEVICE AND LIQUID CRYSTAL DISPLAY DEVICE

CROSS-REFERENCES TO RELATED APPLICATIONS

The present application claims priority from Chinese Patent Application No. 201410268690.9, filed with the Chinese Patent Office on Jun. 16, 2014 and entitled "Backlight Control Method and Device and Liquid Crystal Display Device", which is hereby incorporated by reference in its entirety.

FIELD

The present invention relates to the liquid crystal display field, and in particular to a backlight control method and device and a liquid crystal display device.

BACKGROUND

Liquid crystal screens use liquid crystal materials as basic components. The liquid crystal materials are filled between two parallel plates. The arrangement conditions of molecules inside the liquid crystal material are changed by using voltage to achieve the purpose of shading and transmitting light, so as to display well-proportioned images with different shades. The liquid crystal screens are widely applied to TVs, mobile phones, computers, outdoor advertisement screens and other products due to their advantages of low power consumption, good picture display effect and the like. Liquid crystal molecules of the liquid crystal screens are non-luminous, so the liquid crystal screens need special backlight sources for providing light to display pictures.

In order to improve the display quality, sense of display layering and contrast ratio of pictures, a backlight source usually employs a dynamic backlight control method. The specific implementation process is as follows: a backlight module of the backlight source is divided into n subregions, a backlight value of each subregion is calculated according to image information of the subregion, and an average value of the backlight values of the n subregions is calculated, so that a gain value is determined according to the average value, and the backlight values are adjusted according to the gain value, so as to allow the backlight of the n subregions to generate corresponding brightness.

During the implementation of the above backlight control process, at least the following problems have been found: in the above method, the n subregions all correspond to one gain value, and the corresponding backlight values are adjusted according to the gain value, which will increase the brightness of a low-brightness picture portion while meeting the brightness of a high-brightness picture portion, so that the brightness of the low-brightness picture portion is too high, the requirements on different image quality enhancements in different display regions of the liquid crystal screen cannot be met, and the display quality and the sense of display layering of pictures are reduced.

SUMMARY

Some embodiment described herein provide a backlight control method and device and a liquid crystal display device, so as to achieve the purposes of meeting the requirements on different image quality enhancements in different display regions of the liquid crystal screen and improving the display quality and the sense of display layering of pictures.

Further, some embodiments described herein provide a backlight control method, which includes: dividing n backlight subregions into m backlight regions, wherein m is an integer greater than 1 but not greater than n; calculating an average backlight value of each backlight region among the m backlight regions; searching, from a pre-acquired gain search table, a gain value corresponding to the average backlight value of each backlight region among the m backlight regions, wherein the gain search table is used for recording a mapping relation between average backlight values and gain values; adjusting backlight values of backlight subregions contained in each backlight region correspondingly according to the gain value corresponding to each backlight region; and outputting adjusted backlight values of the n backlight subregions.

Even further, some embodiments described herein provide a backlight control device, which includes a memory and one or more processors, wherein the memory is configured to store computer readable program codes, and the one or more processors execute the computer readable program codes to implement: dividing n backlight subregions into m backlight regions, wherein m is an integer greater than 1 but not greater than n; acquiring an average backlight value of each backlight region among the m backlight regions; searching, from a pre-acquired gain search table, a gain value corresponding to the average backlight value of each backlight region among the m backlight regions, wherein the gain search table is used for recording a mapping relation between average backlight values and gain values; adjusting backlight values of backlight subregions contained in each backlight region correspondingly according to the gain value corresponding to each backlight region; and outputting adjusted backlight values of the n backlight subregions.

Even further, some embodiments described herein provide a liquid crystal display device, which includes a backlight control device and at least one backlight power supply, wherein the backlight control device is the device described in the foregoing embodiment; and the at least one backlight power supply is configured to supply power to the backlight control device.

BRIEF DESCRIPTION OF THE DRAWINGS

In order to describe the technical solutions of the embodiments described herein more clearly, the accompanying drawings used for describing the embodiments will be briefly introduced below. The accompanying drawings in the following description show merely some embodiments, although further embodiments will be understood from these accompanying drawings.

DETAILED DESCRIPTION OF THE EMBODIMENTS

The technical solutions in the embodiments will be clearly described below with reference to the accompanying drawings in the embodiments. Apparently, the described embodiments are merely a part of but not all of embodiments. Based on the embodiments described herein, additional embodiments will be understood by those of skill in the art and said additional embodiments shall be within the protection scope.

Figure 1:
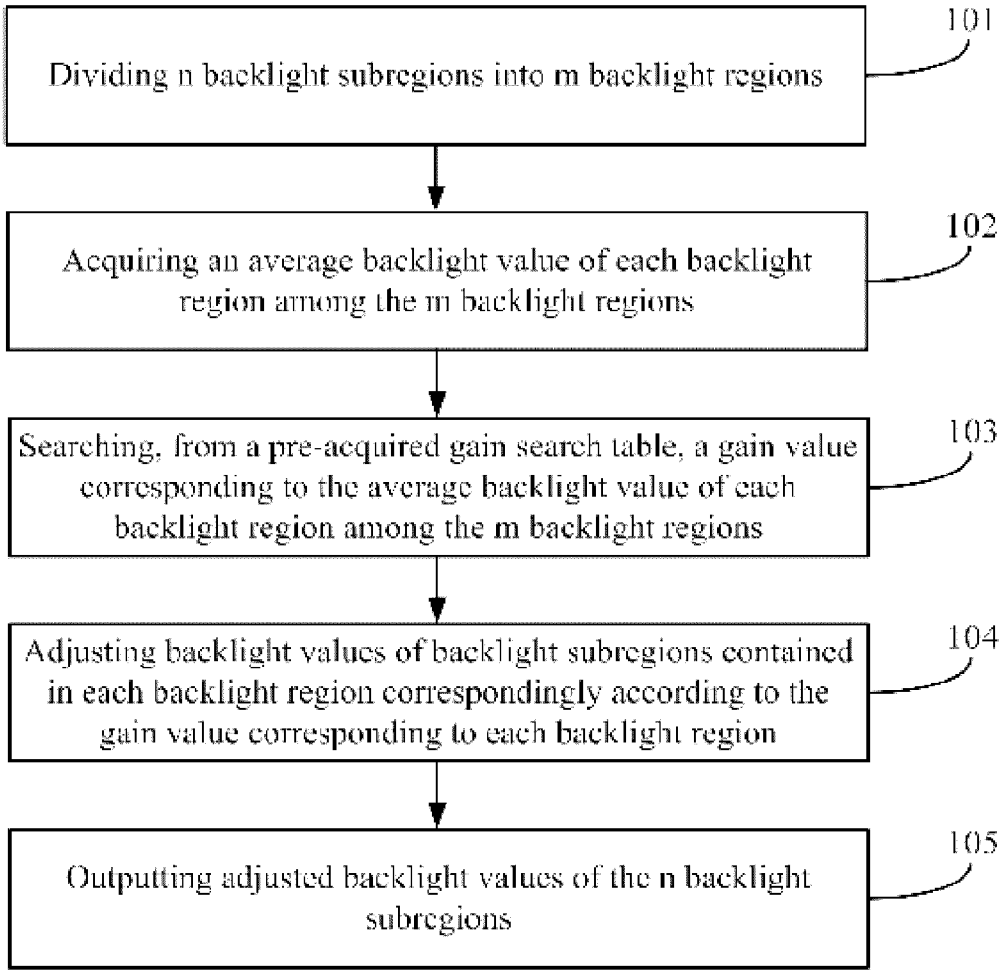
FIG. 1 is a schematic diagram of a backlight control method according to an embodiment.

An embodiment provides a backlight control method, as shown in FIG. 1, which includes:

Step 101: dividing n backlight subregions into m backlight regions.

Here m is an integer greater than 1 but not greater than n.

The n backlight subregions can be n pre-divided backlight subregions, or can be obtained through the real-time processing or dividing operation in some algorithm.

After acquiring n backlight subregions in advance, the backlight control device can use every n/m backlight subregions as one backlight region, so that n backlight subregions are divided into m backlight regions.

It shall be noted that the backlight subregions can be divided according to the arrangement and the number of segments of an LED light bar. The light bar can be controlled separately after being segmented. The liquid crystal screen is manually divided into several display subregions, each of which corresponds to a backlight subregion determined by the LED light bar in the backlight module.

Figure 2:
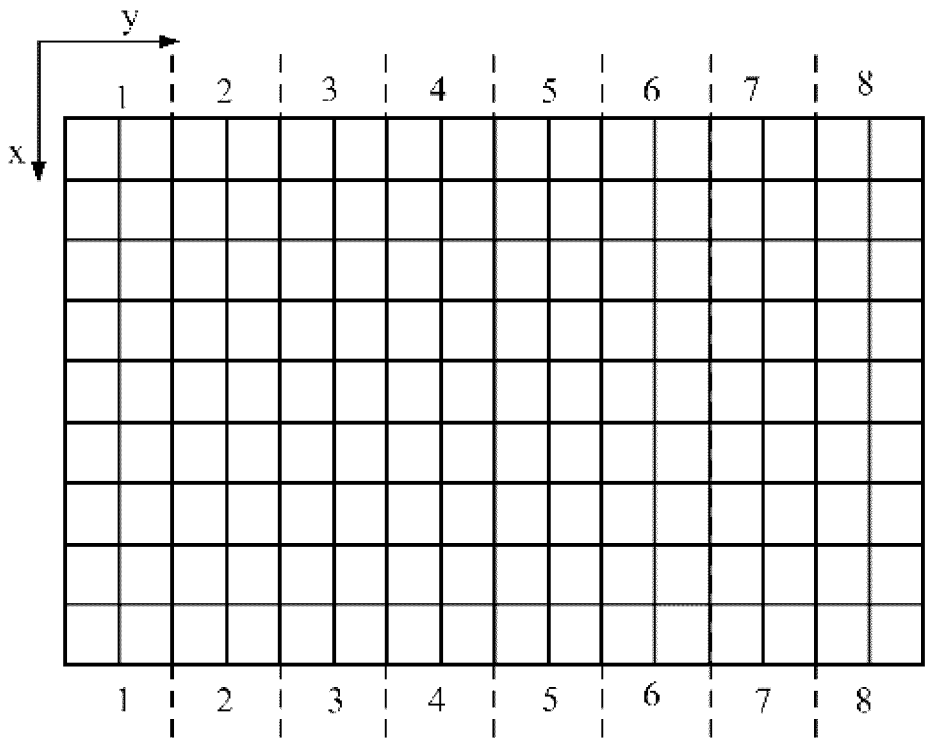
FIG. 2 is an exemplary diagram of a backlight region according to an embodiment.

In an embodiment, the backlight control device acquires 144 backlight subregions in advance and can use every 18 backlight subregions of the 144 backlight subregions as one backlight region, so that there are 8 backlight regions, as shown in FIG. 2.

Step 102: acquiring an average backlight value of each backlight region among the m backlight regions.

After dividing the n backlight subregions into m backlight regions, the backlight control device can determine an average backlight value of each backlight region among the m backlight regions according to backlight values of backlight subregions in each backlight region among the m backlight regions.

It shall be noted that the backlight values of the n backlight subregions are acquired when the n backlight subregions are pre-acquired.

Further, the backlight control device calculates an average value of backlight values of at least two backlight subregions contained in each backlight region among the m backlight regions. The calculated average value of the backlight values of the at least two backlight subregions contained in each backlight region is used as the average backlight value of each backlight region among the m backlight regions.

That is, after dividing the n backlight subregions into m backlight regions, the backlight control device calculates backlight values of at least two backlight subregions contained in each backlight region, calculates an average value of the backlight values of the at least two backlight subregions contained in each backlight region, and uses the average value corresponding to each backlight region as the average backlight value of each backlight region among the m backlight regions.

Optionally, the backlight control device calculates an average value of backlight values of all backlight subregions contained in each backlight region among the m backlight regions. The calculated average value of the backlight values of all backlight subregions contained in each backlight region is used as the average backlight value of each backlight region among the m backlight regions.

It shall be noted that the backlight control device can also acquire the average backlight value of each backlight region among the m backlight regions by using other methods. For example, a backlight value of the $a^{th}$ backlight subregion contained in a backlight region is used as an average backlight value of the backlight region, wherein a is a value greater than 0. The value of a is not limited in this method.

Step 103: searching, from a pre-acquired gain search table, a gain value corresponding to the average backlight value of each backlight region among the m backlight regions.

The gain search table is used for recording a mapping relation between average backlight values and gain values.

After acquiring the average backlight value of each backlight region among the m backlight regions, the backlight control device searches, from the gain search table, for the gain value corresponding to the average backlight value of each backlight region according to the average backlight value of each backlight region.

Further, at least one gain curve is recorded in the gain search table, wherein the gain curve is a curve identifying a mapping relation between average backlight values and gain values. That is, the gain search table identifies the mapping relation between the average backlight values and the gain values through the gain curve.

At this time, the step of searching, by the backlight control device from the pre-acquired gain search table, the gain value corresponding to the average backlight value of each backlight region among the m backlight regions, includes:

searching, from the pre-acquired gain search table, a gain curve corresponding to each backlight region among the m backlight regions; and determining, according to the average backlight value of each backlight region among the m backlight regions, the gain value corresponding to the average backlight value of each backlight region among the m backlight regions in the gain curve corresponding to each backlight region among the m backlight regions.

That is, the backlight control device can search the gain curve corresponding to each backlight region from the pre-acquired gain search table and search the gain value corresponding to the average backlight value of each backlight region from the gain curve corresponding to each backlight region after acquiring the average backlight value of each backlight region among the m backlight regions.

It shall be noted that the gain curve corresponding to each backlight region is preset. The m backlight regions can correspond to at least one gain curve. That is, the m backlight regions can correspond to one gain curve or at least two gain curves. That is, the gain curves corresponding to at least two backlight regions among the m backlight regions can be identical.

In some embodiments, a gain curve corresponding to the $i^{th}$ backlight region is identical to a gain curve corresponding to the $(m-i+1)^{th}$ backlight region.

Here i is an integer greater than 0 but not greater than m.

Figure 3:
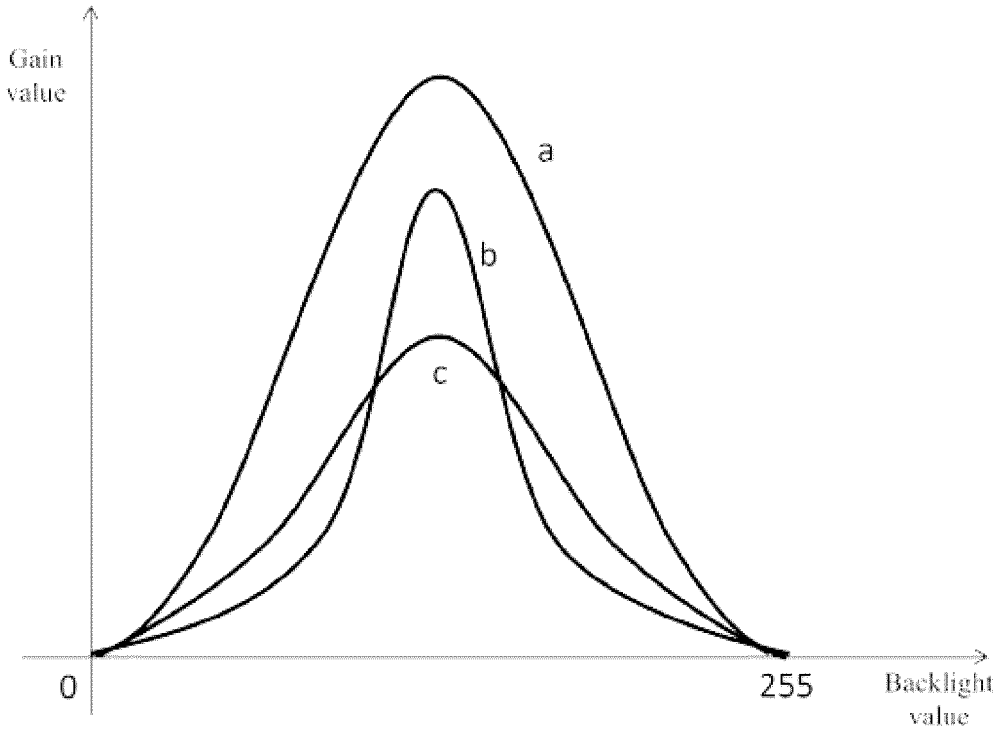
FIG. 3 is an exemplary diagram of a gain curve according to an embodiment.

As described above, the backlight control device divides 144 backlight subregions into 8 backlight regions, and presets 3 gain curves, i.e., gain curves a, b and c, corresponding to the 8 backlight regions, where it is preset that the backlight region 1 and the backlight region 8 correspond to the gain curve c, the backlight region 2 and the backlight region 7 correspond to the gain curve b, and the backlight region 3, the backlight region 4, the backlight region 5 and the backlight region 6 correspond to the gain curve a, as shown in FIG. 3.

Figure 4:
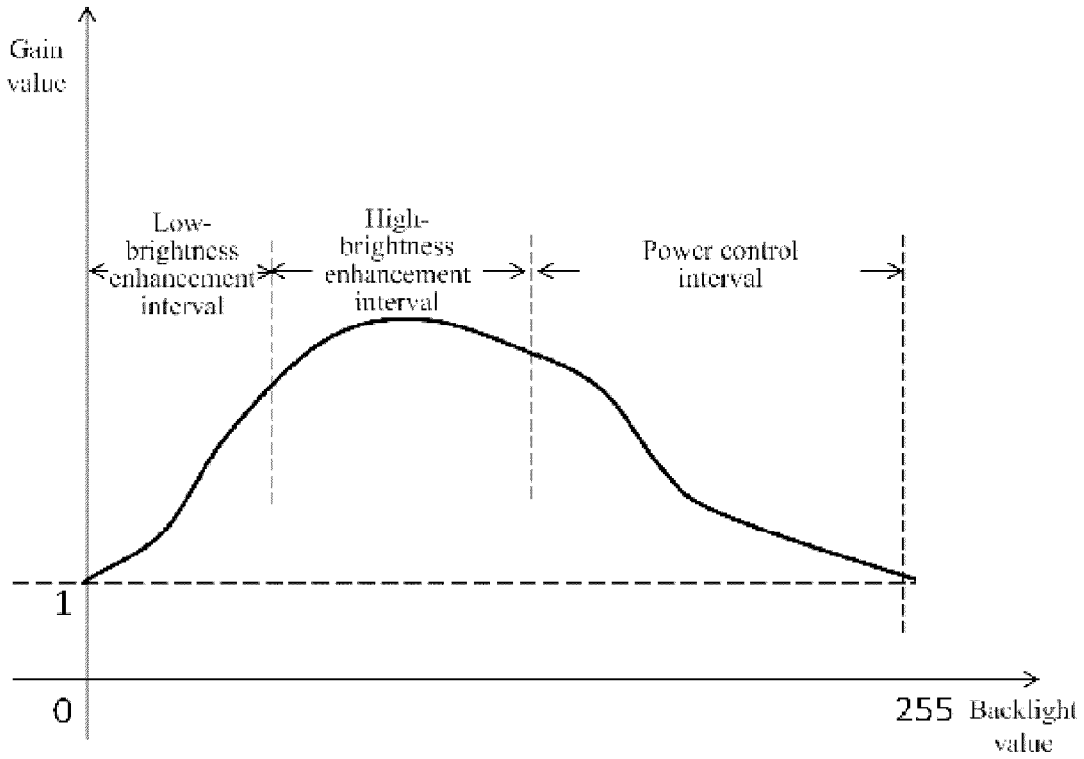
FIG. 4 is an exemplary diagram of another grain curve according to an embodiment.

Further, the gain curve includes a low-brightness enhancement region, a high-brightness enhancement region and a power control region, as shown in FIG. 4.

A gain value in the low-brightness enhancement region is not greater than a gain value in the high-brightness enhancement region, a gain value in the power control region is not greater than the gain value in the high-brightness enhancement region, a backlight value in the low-brightness enhancement region is less than a backlight value in the high-brightness enhancement region, and the backlight value in the high-brightness enhancement region is less than a backlight value in the power control region.

It shall be noted that the gain curve is set to three portions including the low-brightness enhancement region, the high-brightness enhancement region and the power control region. In the low-brightness enhancement region, the backlight value is relatively small and the gain value is also relatively small, so that the average backlight value of backlight regions in the low-brightness picture portion is relatively small; and when this average backlight value is in the low-brightness enhancement region, a corresponding gain value can be searched in the low-brightness enhancement region, and at this time, the gain value is relatively small, to thereby ensure that the brightness of the low-brightness picture portion is not too high. The backlight value in the high-brightness enhancement region is greater than the backlight value in the low-brightness enhancement region but less than the backlight value in the power control region, and the gain value in the high-brightness enhancement region is relatively large, so that a corresponding gain value can be searched in the high-brightness enhancement region when the average backlight value of backlight regions in the high-brightness picture portion is in the high-brightness enhancement region. At this time, the larger gain value makes a gain value corresponding to the backlight subregions of the high-brightness picture portion larger, so that the backlight values of the backlight subregions of the high-brightness picture portion can be increased to thereby highlight the high-brightness portion of the high-brightness picture portion. The backlight value in the power control region is relatively large, and the gain value in the power control region is relatively small and less than the gain value in the high-brightness enhancement region. Thus, when the average backlight value of the backlight regions is in the power control region, it is indicated that the average backlight value of the backlight regions is relatively high, that is, the average brightness of a picture corresponding to the whole backlight region is high enough, and the displayed picture is bright enough without increasing the backlight value substantially. On the contrary, due to the restriction to power consumption, the backlight enhancement effect can be reduced, so the gain value in the power control region is relatively small, the power consumption is reduced, the occurrence of an over-current protection phenomenon is avoided, and the system stability is improved.

It shall be noted that the backlight value in the low-brightness enhancement region is not greater than a first threshold value, the backlight value in the high-brightness enhancement region is greater than the first threshold value but not greater than a second threshold value, and the backlight value in the power control region is greater than the second threshold value. First threshold values and second threshold values corresponding to different gain curves can be identical or different, and need not be limited.

It shall be noted that the first threshold and the second threshold are preset. The first threshold and the second threshold can be set according to different requirements of the liquid crystal display device on the picture brightness.

Figure 5:
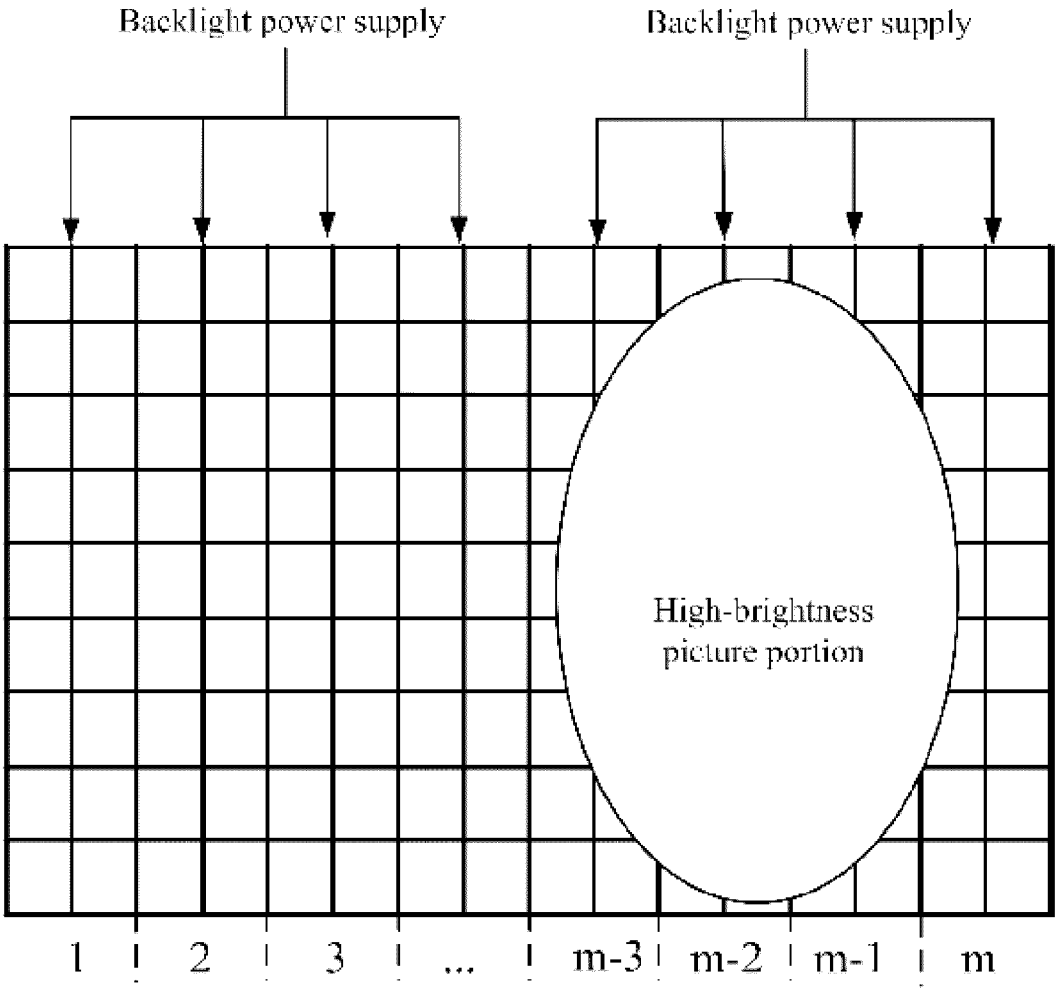
FIG. 5 is an exemplary diagram of supplying power of a backlight power supply according to an embodiment.

It shall be noted that the gain curve includes the low-brightness enhancement region, the high-brightness enhancement region and the power control region, and the dividing of n backlight subregions into m backlight regions can improve the power balance effect. In previous embodiments, n backlight subregions correspond to one gain curve, and a corresponding gain value is acquired according to the average value of the backlight values of all the backlight subregions. In the case that the high-brightness picture portion is centralized on one side, as shown in FIG. 5, because the corresponding gain value is acquired according to the average value of the backlight values of all the backlight subregions, the backlight value in the low-brightness picture portion is relatively small although the backlight value in the high-brightness picture portion is relatively large. At this time, when the average value of backlight values of the whole picture is acquired, it is possible to make the average value be in the high-brightness enhancement region of the gain curve, so that the corresponding gain value is relatively high at this time. Adjusting of the backlight values of the whole picture using the gain value will cause the backlight value of the high-brightness picture portion to be output in a larger gain based on its original value, so that the power of a backlight power supply for supplying power to this portion is relatively large so as to generate the over-current protection, and the power of a backlight power supply for supplying power to the low-brightness picture portion is relatively small so as to cause unbalanced power.

However in some embodiments, n backlight subregions are divided into m backlight regions. When the high-brightness picture portion is centralized on one side, the high-brightness picture portion may be in different backlight regions, as shown in FIG. 5. In these embodiments, average backlight values of different backlight regions are acquired respectively for different backlight regions, and corresponding gain values are acquired according to the respective average backlight values. That is, the average backlight value and the corresponding gain value of each backlight region are acquired with respect to each backlight region. At this time, the calculated average backlight value of the backlight regions corresponding to the high-brightness picture portion is relatively large. When a gain curve is searched according to the average backlight value, the average backlight value of a part of the backlight regions corresponding to the high-brightness picture portion should be in the power control region of the gain curve, and the corresponding gain value is relatively small at this time. Thus, not all of the backlight values of the high-brightness picture portion are output in a larger gain based on original values, while a part of the backlight values are output in a smaller gain based on original values, so that the gain control is more accurate, and the power of a backlight power supply for supplying power to this portion is reduced. Consequently, the power consumption of each backlight power supply for supplying power is better balanced, and the power balance effect is improved.

Step 104: adjusting backlight values of backlight subregions contained in each backlight region correspondingly according to the gain value corresponding to each backlight region.

After acquiring the gain value of each backlight region, the backlight control device can adjust backlight values of all the backlight subregions contained in each region according to the gain value correspondingly. For example, the backlight values of all the backlight subregions contained in each region are multiplied by the gain value, and the products are used as adjusted backlight values of the backlight subregions contained in each region.

It shall be noted that the backlight control device can also correspondingly adjust the backlight values of the backlight subregions contained in each region according to the gain value corresponding to each backlight region by using other methods, and the other methods need not be limited.

Step 105: outputting adjusted backlight values of the n backlight subregions.

After adjusting the backlight values of the backlight subregions contained in each backlight region, i.e., after adjusting the backlight values of the n backlight subregions, the backlight control device outputs the adjusted backlight values of the n backlight subregions to a backlight driving circuit of a liquid crystal display module.

In the backlight control method according to some embodiments, the backlight control device divides n backlight subregions into m backlight regions, acquires an average backlight value of each of the m backlight regions, searches, from a pre-acquired gain search table, a gain value corresponding to the average backlight value of each backlight region, and adjusts backlight values of backlight subregions contained in each backlight region according to the gain value corresponding to the average backlight value of each backlight region so as to output the adjusted backlight values. Thus, the backlight control device can divide a high-brightness picture portion and a low-brightness picture portion into different backlight regions so as to make gain values corresponding to backlight regions corresponding to the high-brightness picture portion be different from gain values corresponding to backlight regions corresponding to the low-brightness picture portion, so that the backlight subregions in the high-brightness picture portion and the backlight subregions in the low-brightness picture portion are subjected to backlight adjustments according to the corresponding gain values respectively, the brightness of the low-brightness picture portion can be met and not be increased when the brightness of the high-brightness picture portion is met, to thereby achieve the purposes of meeting the requirements on different image quality enhancements in different display regions of the liquid crystal screen and improving the display quality and the sense of display layering of pictures.

Figure 6:
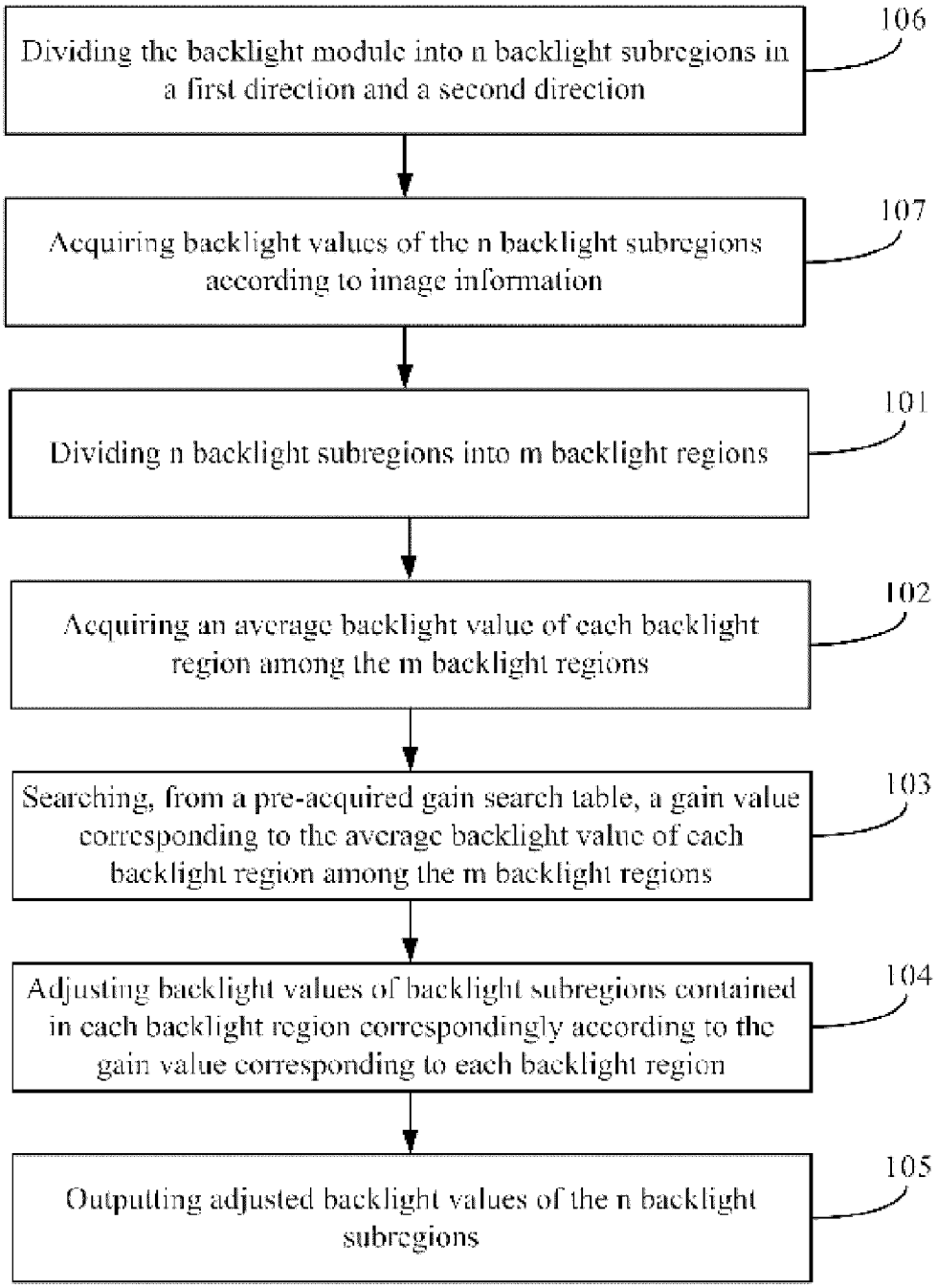
FIG. 6 is a schematic diagram of another backlight control method according to an embodiment.

Further, as shown in FIG. 6, before the step 101, the above method further includes:

Step 106: dividing the backlight module into n backlight subregions in a first direction and a second direction.

The backlight control device divides the backlight module into q*p backlight subregions, i.e., n backlight subregions, in the first direction and the second direction according to a light mixing distance and control complexity.

Further, in the step 102, dividing n backlight subregions into m backlight regions includes: dividing the n backlight subregions into m backlight regions in the second direction.

Preferably, the first direction is a vertical direction, and the second direction is a horizontal direction. Exemplarily, as shown in FIG. 2, the first direction is a direction of the x axis, and the second direction is a direction of the y axis.

Step 107: acquiring backlight values of the n backlight subregions according to image information.

After dividing the backlight module into n backlight subregions, the backlight control device can acquire an image grey value of each backlight subregion according to the image information corresponding to each backlight subregion, and further determine its corresponding backlight value.

It shall be noted that the process of determining, by the backlight control device, the corresponding backlight value according to the image information corresponding to each backlight subregion is generally understood by those of skill in the art, and will not be repeated here.

In the backlight control method according to some embodiments, the backlight control device divides n backlight subregions into m backlight regions, acquires an average backlight value of each of the m backlight regions, searches, from a pre-acquired gain search table, a gain value corresponding to the average backlight value of each backlight region, and adjusts backlight values of backlight subregions contained in each backlight region according to the gain value corresponding to the average backlight value of each backlight region so as to output the adjusted backlight values. Thus, the backlight control device can divide a high-brightness picture portion and a low-brightness picture portion into different backlight regions so as to make gain values corresponding to backlight regions corresponding to the high-brightness picture portion be different from gain values corresponding to backlight regions corresponding to the low-brightness picture portion, so that the backlight subregions in the high-brightness picture portion and the backlight subregions in the low-brightness picture portion are subjected to backlight adjustments according to the corresponding gain values respectively, the brightness of the low-brightness picture portion can be met and not be increased when the brightness of the high-brightness picture portion is met, to thereby achieve the purposes of meeting the requirements on different image quality enhancements in different display regions of the liquid crystal screen and improving the display quality and the sense of display layering of pictures. Furthermore, the n backlight subregions are divided into m backlight regions, the average backlight value and its corresponding gain value of each of the m backlight regions are acquired, and backlight values are adjusted correspondingly, so that the accuracy of gain control is increased, and the power balance effect is improved.

Figure 7:
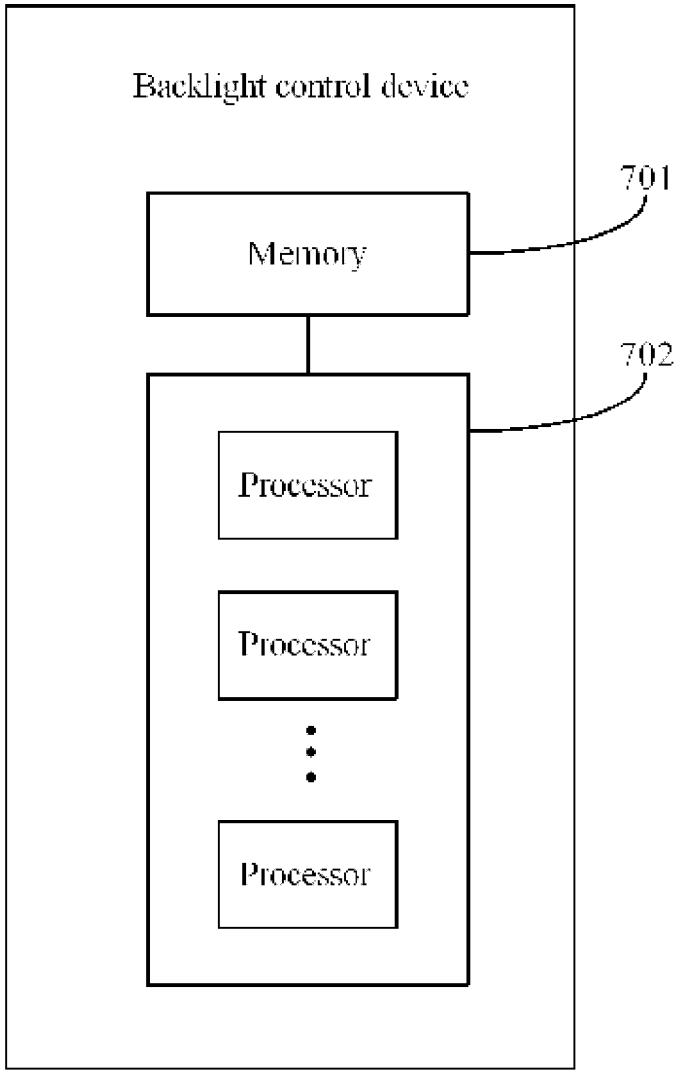
FIG. 7 is a schematic structure diagram of a backlight control device according to an embodiment.

An embodiment provides a backlight control device. As shown in FIG. 7, the backlight control device includes a memory 701 and one or more processors 702, wherein:

the memory 701 is configured to store computer readable program codes, and the one or more processors 702 execute the computer readable program codes to implement:

dividing n backlight subregions into m backlight regions, wherein m is an integer greater than 1 but not greater than n;

acquiring an average backlight value of each backlight region among the m backlight regions;

searching, from a pre-acquired gain search table, a gain value corresponding to the average backlight value of each backlight region among the m backlight regions, wherein the gain search table is used for recording a mapping relation between average backlight values and gain values;

adjusting backlight values of backlight subregions contained in each backlight region correspondingly according to the gain value corresponding to each backlight region; and outputting adjusted backlight values of the n backlight subregions.

Acquiring the average backlight value of each backlight region among the m backlight regions comprises: calculating an average value of backlight values of at least two backlight subregions contained in each backlight region among the m backlight regions; and using the calculated average value of the backlight values of the at least two backlight subregions contained in each backlight region as the average backlight value of each backlight region among the m backlight regions.

In some embodiments, acquiring the average backlight value of each backlight region among the m backlight regions comprises: calculating an average value of backlight values of all the backlight subregions contained in each backlight region among the m backlight regions; and using the calculated average value of the backlight values of all the backlight subregions contained in each backlight region as the average backlight value of each backlight region among the m backlight regions.

Searching, from the pre-acquired gain search table, the gain value corresponding to the average backlight value of each backlight region among the m backlight regions comprises: searching, from the pre-acquired gain search table, a gain curve corresponding to each backlight region among the m backlight regions; and determining, according to the average backlight value of each backlight region among the m backlight regions, the gain value corresponding to the average backlight value of each backlight region among the m backlight regions in the gain curve corresponding to each backlight region among the m backlight regions.

Here the gain curve is a curve identifying a mapping relation between average backlight values and gain values.

It shall be noted that the gain curve corresponding to each backlight region is preset. The m backlight regions can correspond to at least one gain curve. That is, the m backlight regions can correspond to one gain curve or at least two gain curves. That is, the gain curves corresponding to at least two backlight regions among the m backlight regions can be identical.

Preferably, a gain curve corresponding to the $i^{th}$ backlight region is identical to a gain curve corresponding to the $(m-i+1)^{th}$ backlight region, where i is an integer greater than 0 but not greater than m.

Further, the gain curve includes a low-brightness enhancement region, a high-brightness enhancement region and a power control region, where a gain value in the low-brightness enhancement region is not greater than a gain value in the high-brightness enhancement region, a gain value in the power control region is not greater than the gain value in the high-brightness enhancement region, a backlight value in the low-brightness enhancement region is less than a backlight value in the high-brightness enhancement region, and the backlight value in the high-brightness enhancement region is less than a backlight value in the power control region.

It shall be noted that the backlight value in the low-brightness enhancement region is not greater than a first threshold value, the backlight value in the high-brightness enhancement region is greater than the first threshold value but not greater than a second threshold value, and the backlight value in the power control region is greater than the second threshold value. First threshold values and second threshold values corresponding to different gain curves can be identical or different, and need not be limited.

It shall be noted that the first threshold and the second threshold are preset. The first threshold and the second threshold can be set according to different requirements of the liquid crystal display device on the picture brightness.

After the gain value of each backlight region is acquired, backlight values of all the backlight subregions contained in each region can be adjusted correspondingly according to the gain value. For example, the backlight values of all the backlight subregions contained in each region are multiplied by the gain value, and the products are used as the adjusted backlight values of the backlight subregions contained in each region.

After the backlight values of the backlight subregions contained in each backlight region are adjusted, i.e., after the backlight values of the n backlight subregions are adjusted, the adjusted backlight values of the n backlight subregions are output to a backlight driving circuit of a liquid crystal display module.

Further, the one or more processors 702 further execute the computer readable program codes to implement: dividing a backlight module into n backlight subregions in a first direction and a second direction; and acquiring backlight values of the n backlight subregions according to image information.

The one or more processors 702 divide the backlight module into q*p backlight subregions, i.e., n backlight subregions, in the first direction and the second direction according to a light mixing distance and control complexity.

At this time, dividing n backlight subregions into m backlight regions includes:

dividing the n backlight subregions into m backlight regions in the second direction.

The n backlight subregions can be n pre-divided backlight subregions, or can be obtained through the real-time processing or dividing operation in some algorithm.

Some embodiments provide the backlight control device, where the backlight control device divides n backlight subregions into m backlight regions, acquires an average backlight value of each of the m backlight regions, searches, from a pre-acquired gain search table, a gain value corresponding to the average backlight value of each backlight region, and adjusts backlight values of backlight subregions contained in each backlight region according to the gain value corresponding to the average backlight value of each backlight region so as to output the adjusted backlight values. Thus, the backlight control device can divide a high-brightness picture portion and a low-brightness picture portion into different backlight regions so as to make gain values corresponding to backlight regions corresponding to the high-brightness picture portion be different from gain values corresponding to backlight regions corresponding to the low-brightness picture portion, so that the backlight subregions in the high-brightness picture portion and the backlight subregions in the low-brightness picture portion are subjected to backlight adjustments according to the corresponding gain values respectively, the brightness of the low-brightness picture portion can be met and not be increased when the brightness of the high-brightness picture portion is met, to thereby achieve the purposes of meeting the requirements on different image quality enhancements in different display regions of the liquid crystal screen and improving the display quality and the sense of display layering of pictures. Furthermore, the n backlight subregions are divided into m backlight regions, the average backlight value and its corresponding gain value of each of the m backlight regions are acquired, and backlight values are adjusted correspondingly, so that the accuracy of gain control is increased, and the power balance effect is improved.

An embodiment provides a liquid crystal display device including a backlight control device and at least one backlight power supply.

Here the backlight control device is the backlight control device described in the foregoing embodiments.

The at least one backlight power supply is configured to supply power to the backlight control device.

Some embodiments provide a backlight control method and device and a liquid crystal display device. The backlight control device divides n backlight subregions into m backlight regions, acquires an average backlight value of each of the m backlight regions, searches, from a pre-acquired gain search table, a gain value corresponding to the average backlight value of each backlight region, and adjusts backlight values of backlight subregions contained in each backlight region according to the gain value corresponding to the average backlight value of each backlight region so as to output the adjusted backlight values. Thus, the backlight control device can divide a high-brightness picture portion and a low-brightness picture portion into different backlight regions so as to make gain values corresponding to backlight regions corresponding to the high-brightness picture portion be different from gain values corresponding to backlight regions corresponding to the low-brightness picture portion, so that the backlight subregions in the high-brightness picture portion and the backlight subregions in the low-brightness picture portion are subjected to backlight adjustments according to the corresponding gain values respectively, the brightness of the low-brightness picture portion can be met and not be increased when the brightness of the high-brightness picture portion is met, to thereby achieve the purposes of meeting the requirements on different image quality enhancements in different display regions of the liquid crystal screen and improving the display quality and the sense of display layering of pictures. Furthermore, the n backlight subregions are divided into m backlight regions, the average backlight value and its corresponding gain value of each of the m backlight regions are acquired, and backlight values are adjusted correspondingly, so that the accuracy of gain control is increased, and the power balance effect is improved.

Those skilled in the art shall appreciate that the inventive concepts described herein can be embodied as a method, a system or a computer program product. Therefore they can be embodied in the form of an all-hardware embodiment, an all-software embodiment or an embodiment of software and hardware in combination. Furthermore, they can be embodied in the form of a computer program product embodied in one or more computer useable storage mediums (including but not limited to a disk memory, a CD-ROM, an optical memory, etc.) in which computer useable program codes are contained.

The embodiments have been described with reference to flow charts and/or block diagrams of the method, the device (system) and the computer program product according to the embodiments. It shall be appreciated that respective flows and/or blocks in the flow charts and/or the block diagrams and combinations of the flows and/or the blocks in the flow charts and/or the block diagrams can be embodied in computer program instructions. These computer program instructions can be loaded onto a general-purpose computer, a specific-purpose computer, an embedded processor or a processor of another programmable data processing device to produce a machine so that the instructions executed on the computer or the processor of the other programmable data processing device create means for performing the functions specified in the flow(s) of the flow charts and/or the block(s) of the block diagrams.

These computer program instructions can also be stored into a computer readable memory capable of directing the computer or the other programmable data processing device to operate in a specific manner so that the instructions stored in the computer readable memory create manufactures including instruction means which perform the functions specified in the flow(s) of the flow charts and/or the block(s) of the block diagrams.

These computer program instructions can also be loaded onto the computer or the other programmable data processing device so that a series of operational steps are performed on the computer or the other programmable data processing device to create a computer implemented process so that the instructions executed on the computer or the other programmable device provide steps for performing the functions specified in the flow(s) of the flow charts and/or the block(s) of the block diagrams.

Although certain preferred embodiments have been described, those skilled in the art benefiting from the underlying inventive concepts can make additional modifications and variations to these embodiments. Therefore the appended claims are intended to be construed as potentially encompassing all of the embodiments and all the modifications and variations coming into the scope of said embodiments.

Those skilled in the art can make various modifications and variations to the embodiments without departing from the spirit and scope of the inventive concepts. Thus the application is also intended to encompass these modifications and variations thereto so long as these modifications and variations come into the scope of the claims and their equivalents.

What is claimed is:

1. A backlight control method, comprising:

sorting n backlight subregions into m backlight regions using a processor, wherein m is an integer greater than 1 but not greater than n;

acquiring an average backlight value of each backlight region among the m backlight regions;

searching, from a pre-acquired gain search table, a gain value corresponding to the average backlight value of each backlight region among the m backlight regions, wherein the gain search table is used for recording a mapping relation between average backlight values and gain values;

adjusting backlight values of backlight subregions contained in each backlight region correspondingly according to the gain value corresponding to each backlight region; and outputting adjusted backlight values of the n backlight subregions.

2. The method according to claim 1, wherein searching, from the pre-acquired gain search table, the gain value corresponding to the average backlight value of each backlight region among the m backlight regions comprises:

searching, from the pre-acquired gain search table, a gain curve corresponding to each backlight region among the m backlight regions, wherein the gain curve is a curve identifying a mapping relation between average backlight values and gain values; and determining, according to the average backlight value of each backlight region among the m backlight regions, the gain value corresponding to the average backlight value of each backlight region among the m backlight regions in the gain curve corresponding to each backlight region among the m backlight regions.

3. The method according to claim 1, wherein acquiring the average backlight value of each backlight region among the m backlight regions comprises:

calculating an average value of backlight values of at least two backlight subregions contained in each backlight region among the m backlight regions; and using the calculated average value of the backlight values of the at least two backlight subregions contained in each backlight region as the average backlight value of each backlight region among the m backlight regions.

4. The method according to claim 2, wherein acquiring the average backlight value of each backlight region among the m backlight regions comprises:

calculating an average value of backlight values of at least two backlight subregions contained in each backlight region among the m backlight regions; and using the calculated average value of the backlight values of the at least two backlight subregions contained in each backlight region as the average backlight value of each backlight region among the m backlight regions.

5. The method according to claim 2, wherein the gain curve comprises a low-brightness enhancement region, a high-brightness enhancement region and a power control region, wherein a gain value in the low-brightness enhancement region is not greater than a gain value in the high-brightness enhancement region, a gain value in the power control region is not greater than the gain value in the high-brightness enhancement region, a backlight value in the low-brightness enhancement region is less than a backlight value in the high-brightness enhancement region, and the backlight value in the high-brightness enhancement region is less than a backlight value in the power control region.

6. The method according to claim 1, wherein a gain curve corresponding to an $i^{th}$ backlight region is identical to a gain curve corresponding to an $(m-i+1)^{th}$ backlight region, wherein i is an integer greater than 0 but not greater than m.

7. The method according to claim 1, wherein before sorting n backlight subregions into m backlight regions, the method further comprises:

sorting a backlight module into n backlight subregions in a first direction and a second direction; and acquiring backlight values of the n backlight subregions according to image information.

8. The method according to claim 7, wherein sorting n backlight subregions into m backlight regions comprises:

sorting the n backlight subregions into m backlight regions in the second direction.

9. The method according to claim 1, wherein the n backlight subregions are n pre-divided backlight subregions.

10. A backlight control device, comprising:

a memory; and one or more processors, wherein:

the memory is configured to store computer readable program codes, and the one or more processors execute the computer readable program codes to implement:

sorting n backlight subregions into m backlight regions, wherein m is an integer greater than 1 but not greater than n;

acquiring an average backlight value of each backlight region among the m backlight regions;

searching, from a pre-acquired gain search table, a gain value corresponding to the average backlight value of each backlight region among the m backlight regions, wherein the gain search table is used for recording a mapping relation between average backlight values and gain values;

adjusting backlight values of backlight subregions contained in each backlight region correspondingly according to the gain value corresponding to each backlight region; and outputting adjusted backlight values of the n backlight subregions.

11. The device according to claim 10, wherein searching, from the pre-acquired gain search table, the gain value corresponding to the average backlight value of each backlight region among the m backlight regions comprises:

searching, from the pre-acquired gain search table, a gain curve corresponding to each backlight region among the m backlight regions, wherein the gain curve is a curve identifying a mapping relation between average backlight values and gain values; and determining, according to the average backlight value of each backlight region among the m backlight regions, the gain value corresponding to the average backlight value of each backlight region among the m backlight regions in the gain curve corresponding to each backlight region among the m backlight regions.

12. The device according to claim 10, wherein acquiring the average backlight value of each backlight region among the m backlight regions comprises:

calculating an average value of backlight values of at least two backlight subregions contained in each backlight region among the m backlight regions; and using the calculated average value of the backlight values of the at least two backlight subregions contained in each backlight region as the average backlight value of each backlight region among the m backlight regions.

13. The device according to claim 11, wherein acquiring the average backlight value of each backlight region among the m backlight regions comprises:

calculating an average value of backlight values of at least two backlight subregions contained in each backlight region among the m backlight regions; and using the calculated average value of the backlight values of the at least two backlight subregions contained in each backlight region as the average backlight value of each backlight region among the m backlight regions.

14. The device according to claim 11, wherein the gain curve comprises a low-brightness enhancement region, a high-brightness enhancement region and a power control region, wherein a gain value in the low-brightness enhancement region is not greater than a gain value in the high-brightness enhancement region, a gain value in the power control region is not greater than the gain value in the high-brightness enhancement region, a backlight value in the low-brightness enhancement region is less than a backlight value in the high-brightness enhancement region, and the backlight value in the high-brightness enhancement region is less than a backlight value in the power control region.

15. The device according to claim 10, wherein a gain curve corresponding to an $i^{th}$ backlight region is identical to a gain curve corresponding to an $(m-i+1)^{th}$ backlight region, wherein i is an integer greater than 0 but not greater than m.

16. The device according to claim 10, wherein the one or more processors further execute the computer readable program codes to implement:

sorting a backlight module into n backlight subregions in a first direction and a second direction; and acquiring backlight values of the n backlight subregions according to image information.

17. The device according to claim 16, wherein sorting n backlight subregions into m backlight regions comprises:

sorting the n backlight subregions into m backlight regions in the second direction.

18. The device according to claim 10, wherein the n backlight subregions are n pre-divided backlight subregions.

19. A liquid crystal display device, comprising a backlight control device and at least one backlight power supply, wherein:

the backlight control device comprises a memory and one or more processors, wherein the memory is configured to store computer readable program codes, and the one or more processors execute the computer readable program codes to implement:

sorting n backlight subregions into m backlight regions, wherein m is an integer greater than 1 but not greater than n;

acquiring an average backlight value of each backlight region among the m backlight regions;

searching, from a pre-acquired gain search table, a gain value corresponding to the average backlight value of each backlight region among the m backlight regions, wherein the gain search table is used for recording a mapping relation between average backlight values and gain values;

adjusting backlight values of backlight subregions contained in each backlight region correspondingly according to the gain value corresponding to each backlight region; and outputting adjusted backlight values of the n backlight subregions; and the at least one backlight power supply is configured to supply power to the backlight control device.

20. The device according to claim 19, wherein the n backlight subregions are n pre-divided backlight subregions.

* * * * *